US005207505A

United States Patent [19]

Naraki et al.

[11] Patent Number: 5,207,505

[45] Date of Patent: May 4, 1993

[54] ILLUMINATION LIGHT SOURCE DEVICE

[75] Inventors: Tsuyoshi Naraki; Haruo Ozawa, both of Tokyo; Takashi Mori, Kawasaki; Jun Nagatsuka, Kawasaki, all of Japan

[73] Assignee: Nikon Corporation, Tokyo, Japan

[21] Appl. No.: 754,028

[22] Filed: Sep. 3, 1991

[30] Foreign Application Priority Data

Sep. 19, 1990 [JP] Japan ..... 2-249294

[51] Int. Cl.[5] ..... F21V 29/00

[52] U.S. Cl. ..... 362/373; 362/294; 362/345; 392/426

[58] Field of Search ..... 362/263, 264, 294, 345, 362/347, 350, 373; 219/405; 392/407, 416, 418, 422, 423, 424, 426

[56] References Cited

U.S. PATENT DOCUMENTS

| | | | |
|---|---|---|---|
| 2,232,156 | 2/1941 | Abeles | 392/426 |
| 2,372,832 | 4/1945 | Jepson | 362/294 |
| 2,679,003 | 5/1954 | Dyke et al. | 392/407 |
| 3,141,086 | 7/1964 | Prager | 392/407 |
| 3,720,806 | 3/1973 | Fotland | 392/422 |
| 4,460,944 | 7/1984 | Gordbegli et al. | 362/273 |
| 4,630,182 | 12/1986 | Moroi et al. | 362/294 |
| 4,681,024 | 7/1987 | Ivey | 362/294 |

FOREIGN PATENT DOCUMENTS

| | | | |
|---|---|---|---|
| 391754 | 2/1969 | U.S.S.R. | 219/354 |
| 1361423 | 12/1987 | U.S.S.R. | 362/31 |
| 197803 | 3/1978 | United Kingdom | 362/294 |

*Primary Examiner*—Ira S. Lazarus
*Assistant Examiner*—Y. Quach
*Attorney, Agent, or Firm*—Shapiro and Shapiro

[57] ABSTRACT

A light source device houses a lamp such as a mercury discharge tube for generating a high temperature heat, and a reflective optical member such as an elliptic, mirror surrounding the lamp, in a lamp case. When the lamp is forcibly cooled by air, a device for substantially uniformly heating or heat-insulating a reflection surface of the reflective optical member is provided to prevent overcooling of the reflective optical member.

20 Claims, 4 Drawing Sheets

ILLUMINATION LIGHT SOURCE DEVICE

BACKGROUND OF THE INVENTION

Field of the Invention

The present invention relates to a light source device which uses a lamp such as a discharge tube which emits a highly brilliant illumination light, and more particularly to a light source device having a concave mirror such as an elliptic mirror or a parabolic mirror arranged with a lamp.

Related Background Art

A light source device of this type has been used in various applications. Among others, a light source device used for a semiconductor exposure apparatus (such as a stepper or an aligner) uses an ultra high pressure mercury discharge tube (Hg lamp or Xe-Hg lamp) to efficiently emit a light of a specific wavelength (g-ray of 436 nm or i-ray of 365 nm).

FIG. 5 is a simplified illustration of an illumination system for a stepper disclosed in U.S. Pat. No. 4,630,182. A light emission point of a lamp 1 is located at a first focal point in an elliptic mirror 2. An opening through which an electrode of the lamp 1 extends is formed at the bottom of the elliptic mirror 2. An alminum layer is coated on an entire inner surface of the elliptic mirror 2 by vapor deposition to form a reflection plane. An illumination light reflected by the elliptic mirror 2 is focused at a second focal point and directed to a secondary light source optical member 3 which includes an interference filter and a fly eye lens. The illumination light which exits from the optical member 3 as a secondary light source reaches a condenser lens 6 through a dichroic mirror 4 and a mirror 5. The illumination light from the condenser lens 6 illuminates a reticle (mask) 7 at a uniform intensity distribution by the operation of the optical member 3. A transmitted light from a circuit pattern formed on the reticle 7 is focused on a resist layer on a surface of a wafer 9 through a projection optical system 8.

The Hg lamp or Xe-Hg lamp of this type is usually used in a position such that an anode and a cathode of discharge electrodes are in a vertical direction. Thus, a mouth piece connected to one of the electrodes is positioned at a center of an opening of the elliptic mirror 2 through which the illumination light is emitted (a side facing the optical member 3).

The lamp 1 and the elliptic mirror 2 are housed in a lamp house (case) 10 to prevent the light from leaking to the exterior, and the optical member 3, the mirrors 4 and 5 and the condenser lens 6 are housed in an illumination optical system housing 11.

Air for cooling the lamp 1 flows into the lamp house 10 through the illumination optical system case 11 and flows out of the lamp house 10 from an opening at the bottom of the elliptic mirror 2.

In the prior art, no essential problem is raised with respect to the cooling of the lamp (discharge tube) and a temperature of a wall of the lamp and a temperature of the mouth piece are maintained within a proper range. However, there has been a problem in that a desired exposure illumination is not attained, in spite of the exchange of the lamp to a new one, over a long period use of the device. The inventors of the present invention studied this problem and found that a primary cause for the reduction of the exposure illumination resides in a blur of the elliptic mirror.

A cause of the blur of the elliptic mirror is that materials (fine particles or molecules) floating in the atmosphere are deposited on the reflection plane of a relatively low temperature by strong light and heat from the lamp. Such materials are densely deposited on the entire surface or a portion of the reflection plane as contaminants and reduce an overall reflection efficiency of the reflection plane.

SUMMARY OF THE INVENTION

In the light of the above, it is an object of the present invention to provide a light source device having a reflective optical member (such as an elliptic mirror) which does not create blur over a long term use.

In accordance with the present invention, when a lamp such as a mercury discharge tube (Hg lamp or Xe-Hg lamp) which generates high temperature heat and a reflective optical member (such as an elliptic mirror, a parabolic mirror or a polygon mirror) which surround the lamp are housed in a lamp case and the lamp is forcibly cooled by air, means for substantially uniformly heating or heat-insulating a reflection plane of the reflective optical member is provided in order to prevent the reflective optical means from overcooling.

According to the study by the inventors of the present invention, ammonium sulfate was detected as one of contaminants deposited on the reflective optical member, although it depends on an operation environment of a stepper on which the reflective optical member is mounted. The material is provided by the coupling of sulfuric acid sulfate ions ($SO_4^{2-}$) floating in the atmosphere due to the high heat of the lamp and ammonium ions ($NH_3^+$) on the surface of the reflective optical member which is at a relatively low temperature. A decomposition temperature of ammonium sulfate is approximately 120° C. Accordingly, if the surface of the reflective optical member is above that temperature, the production and deposition of the ammonium sulfate can be prevented.

A special thin film is vapor-deposited on the surface of the reflective optical member to attain a desired optical characteristic. Typically, an aluminum layer ($Al+SiO$ film or $Al+MgF_2$ film) is vapor deposited on a surface of a glass material which has a three-dimensional shape such as an elliptic mirror or a parabolic mirror for use as a reflection plane, or a dielectric multilayer film is deposited to form a reflection plane. Thus, when the reflective optical member is heated to a temperature, or the temperature thereof is preserved, above the decomposition temperature of the contaminants deposited on the mirror surface, it must be set below a long term heat resistive temperature of the thin film formed on the mirror surface.

In accordance with the present invention, a blur of the reflective optical member or the glass member such as a lens disposed in the vicinity of the lamp in the light source device or in the illumination light path is prevented, and the illumination power is not lowered over the long term illumination and the maintenance for the optical member is eliminated.

DETAILED DESCRIPTION OF THE PREFERRED EMBODIMENTS

Figure 1:
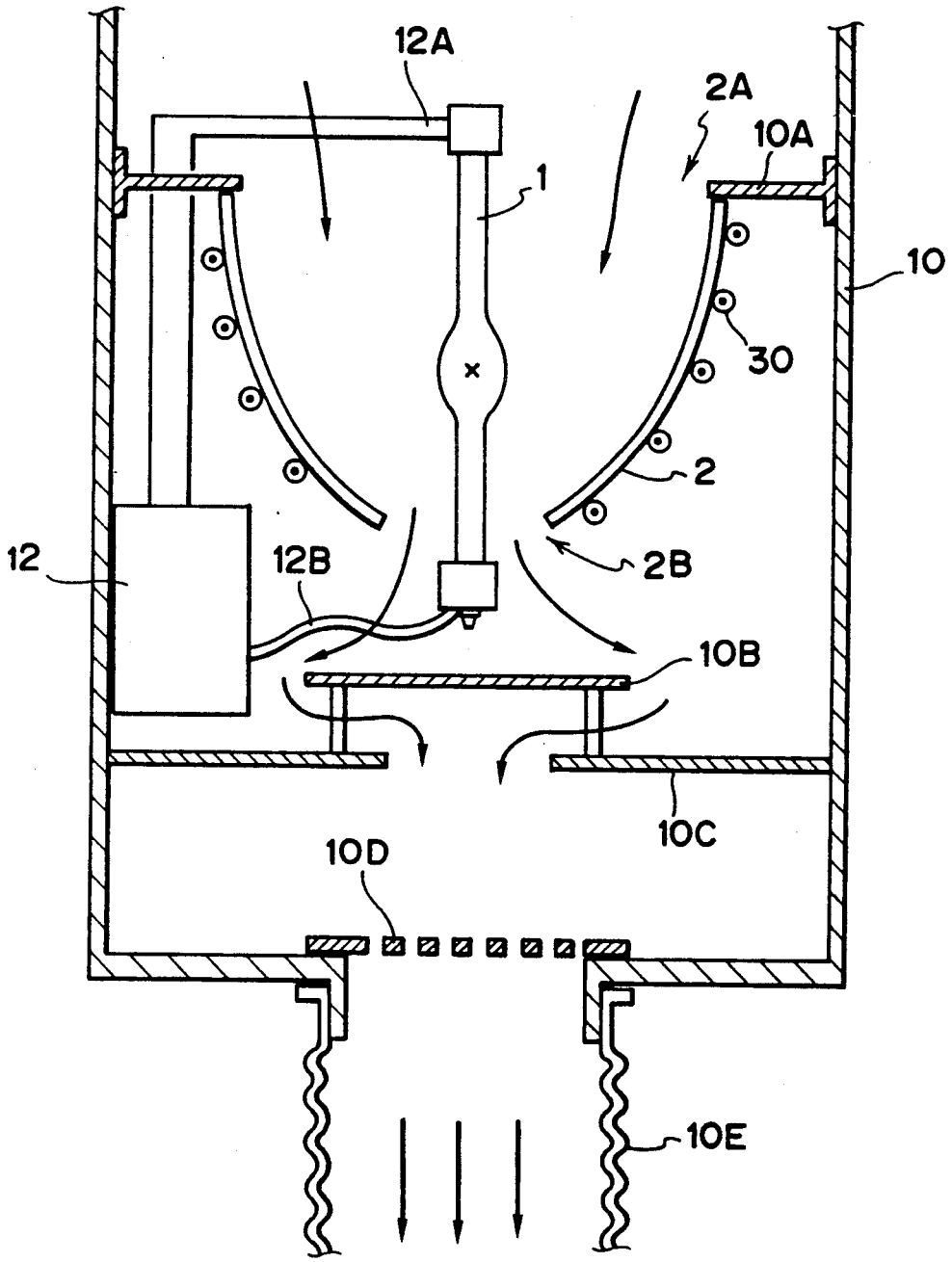
FIG. 1 shows a schematic construction of a light source device in accordance with a first embodiment of the present invention.

FIG. 1 shows a schematic construction of a light source device in accordance with a first embodiment of the present invention. An elliptic mirror 2 in a lamp house 10 is held by a support plate 10A at an exit 2A of a light beam. An electric heater 30 is wound around the elliptic mirror 2 to forcibly heat the elliptic mirror 2. An upper mouth piece of a lamp 1 is held in suspension by an upper support leaf spring 12A which also serves as a lead wire. The support leaf spring 12A is connected to a centering mechanism 12. A lead wire 12B is connected to a lower mouth piece of the lamp 1. The centering mechanism 12 three-dimensionally moves the lamp in an attitude shown in FIG. 1 in order to bring a light emission point of the lamp 1 to a first focal point of the elliptic mirror 2. Shield plates 10B and 10C, which shield a highly brilliant illumination light travelling downward from a lower opening 2B of the elliptic mirror 2, and which control a cooling air flow, are formed in lamination at the bottom of the lamp house 10.

Figure 5:
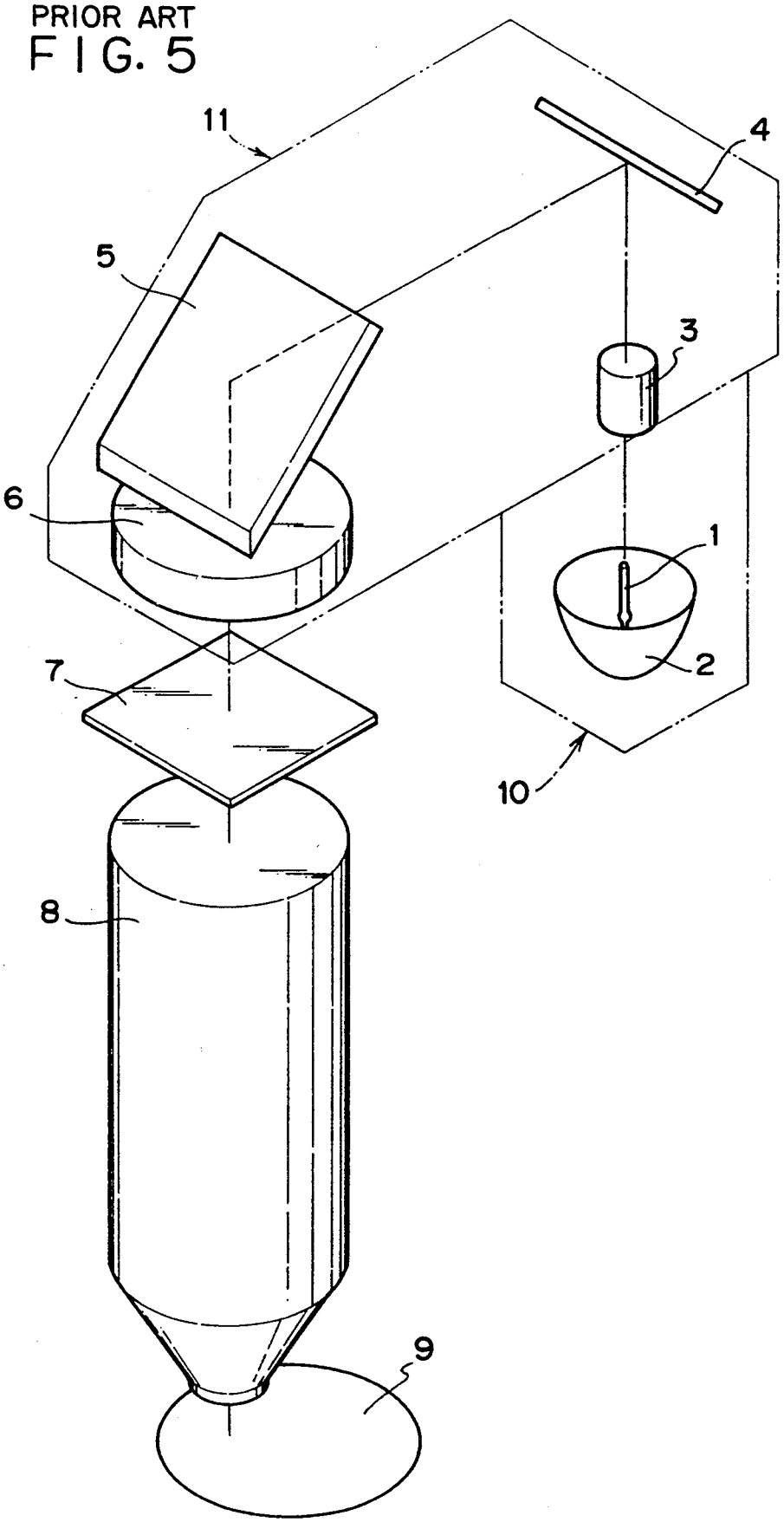
PRIOR ART FIG. 5
FIG. 5 shows an arrangement of an optical system of a prior art stepper.

A venting duct 10E is provided at the bottom-most part of the lamp house 10 through a metallic mesh 10D. The duct 10E forcibly evacuates high temperature air in the lamp house 10 to the exterior of the stepper in order to cool the lamp 1 and the elliptic mirror 2. The cooling air flows into the lamp house 10 through an illumination optical system case 11 (see FIG. 5) and is directed to the lower opening 2B through the exit 2A of the elliptic mirror 2.

Figure 2:
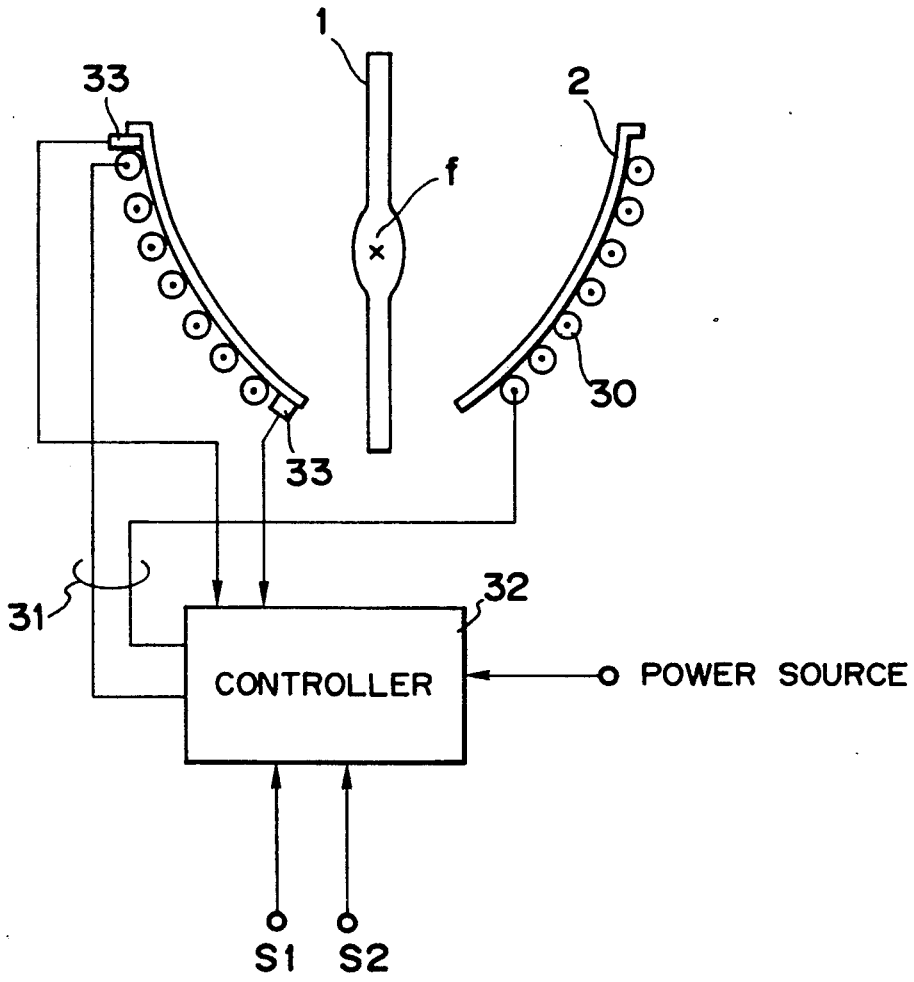
FIG. 2 shows a principal part of the light source device of the first embodiment.

FIG. 2 shows a structure of the elliptic mirror of the light source device in the first embodiment of the present invention. The light emission point of the lamp 1 is positioned at the first focal point f of the elliptic mirror 2. An aluminum layer is coated on an inner surface of the elliptic mirror 2. It serves as a high reflection index mirror over a wide wavelength range from an ultraviolet area to an infrared area. A heater 30 made of a nichrome wire or ceramic is wound around the elliptic mirror 2 in accordance with a temperature distribution of the elliptic mirror, and it is heated by a temperature controller 32 through a power supply line 31. A temperature sensor 33 is fixed to a portion of the elliptic mirror 2, preferably at the exit of the light beam or at the lower opening which is at a lowest temperature by the air cooling, and an output signal thereof is sent to the controller 32 for the temperature feedback control of the heater 30. The controller 32 can receive two or more information $S_1$ and $S_2$. The information $S_1$ relates to a set temperature of the elliptic mirror 2 (for example, higher than the decomposition temperature of ammonium sulfate). The information $S_2$ is a flag signal which selects the energization to the heater 30 when a cover of the lamp house is opened for maintenance or exchange of lamp.

In such a heating device, precise temperature control is not necessary and the temperature sensor 33 may be a bimetal switch which is fixed to a portion of the elliptic mirror 2 or a portion of the nichrome wire of the heater 30. In this case, the bimetal switch is selected to close its contact below the decomposition temperature of the contaminant (for example, 120° C.) and opens its contact above the decomposition temperature. It may be simply connected in series with the power supply line 31.

In accordance with the first embodiment, the temperature of the elliptic mirror 2 may be kept above the decomposition temperature of the contaminant (for example, ammonium sulfate) whether the lamp 1 is turned on or off. By using the feedback system including the temperature sensor 33 or the bimetal switch, the total power supply from the controller 32 to the heater 30 may be reduced during the turn-on of the lamp 1 because the temperature of the elliptic mirror 2 rises by the heat of the lamp 1.

When a temperature sensor 33 of high linearity is used, a circuit having a temperature hysteresis to the energization of the heater 30 may be used. Namely, when the detection temperature of the temperature sensor 33 drops to a first temperature $t_1$ (for example, 120° C.) near the decomposition temperature, the heater 30 is immediately energized, and once it is energized, the energization is continued until a second temperature $t_2$ which is sufficiently higher than the first temperature $t_1$ (but lower than the heating temperature of the heater 30 and lower than the heat resistive temperature of the coated layer) is reached. After the energization is stopped at the temperature $t_2$, the energization is not initiated until the temperature drops to the temperature $t_1$.

In the first embodiment, the temperature sensor 33 and the bimetal switch are used to control the current flowing through the heater 30 although the temperature monitor need not be used. Where the mirror surface is coated with the aluminum layer, the heat resistive temperature is approximately 200° C. while the decomposition temperature of ammonium sulfate is approximately 120° C. Accordingly, a current (or more exactly, a power) supplied to the heater 30 may be selected by an experiment such that the temperature of the elliptic mirror 2 reaches approximately 130~180° C. and that power may be simply supplied to the heater 30. The supply to the heater 30 may be linked to the supply to the lamp 1.

Figure 3:
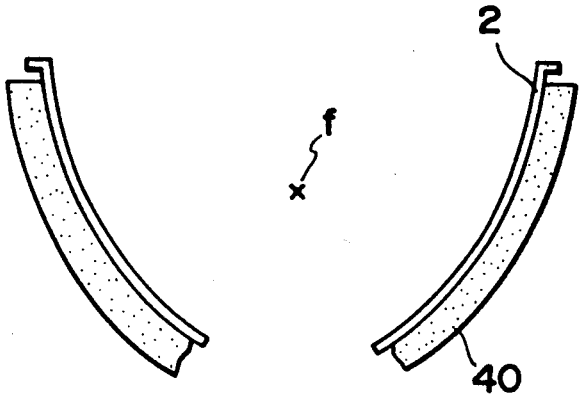
FIG. 3 shows a principal part of the light source device in accordance with a second embodiment of the present invention.

FIG. 3 shows a second embodiment of the present invention. Instead of the forced heating, a heat insulating material 40 is wrapped around the elliptic mirror 2. The heat insulating material 40 is selected to be heat resistive up to approximately 200° C.

Figure 4:
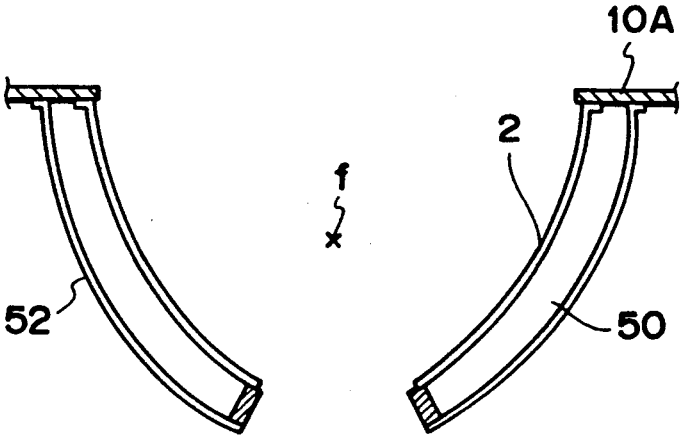
FIG. 4 shows a principal part of the light source device in accordance with a third embodiment of the present invention.

FIG. 4 shows a third embodiment in which the outer periphery of the elliptic mirror 2 is covered by a metallic (for example, stainless steel) protector 52 with a predetermined space 50. The space 50 is substantially sealed to prevent the cooling air from flowing therein. By the provision of the space 50, the same heat insulation effect as that of the second embodiment is attained. The space 50 may be evacuated or filled with carbon dioxide gas having a high heat insulation efficiency.

The heat insulation system shown in FIGS. 3 and 4 is effective for certain mirror members. For example, when a dielectric multi-layer film is used for forming the mirror surface, a wavelength dependency may be imparted to the reflectivity (or transmissivity). Accordingly, light of undesired wavelength (particularly, a long wavelength) can be absorbed by the dielectric multi-layer film and the temperature may be raised to a higher point than that permitted to the elliptic mirror with only the aluminum coated film. However, depending on the air cooling condition of the lamp house, the temperature may not reach the decomposition temperature of the contaminant even with the elliptic mirror having the multi-layer film. In such a case, the heat insulation shown in FIGS. 3 and 4 may be used so that the temperature above the decomposition temperature is easily attained and the deposition of the contaminant can be prevented in a very simple manner.

The present invention has been described in connection with the embodiments. The device to which the present invention is applied is not limited to that which uses the elliptic mirror or the parabolic mirror but the present invention is equally applicable to a light source device having a light focusing system which is a combination of a reflection mirror and a lens or a prism.

The present invention is also applicable to a lens element or a reflection mirror which is likely to create blur in the light source device.

A far infrared ceramic heater or a hot air heater may be used to heat the reflective optical member, lens element or prism.

What is claimed is:

1. A light source device for irradiating an object, comprising:

a lamp operable for emitting light, said lamp creating heat during the emission of light;

an optical member disposed near said lamp for directing light from said lamp toward said object;

means for supplying cooling gas to a space between said lamp and said optical member for cooling said lamp; and means for controlling the temperature of said optical member, said optical member, in the absence of said temperature controlling means, being subject to a reduction in its ability to direct light from said lamp toward said object, due to deposition of a contaminant on said optical member, said contaminant having a decomposition temperature at which deposition of said contaminant on said optical member is prevented and below which such deposition occurs, said temperature controlling means setting the temperature of said optical member, during the operation of said lamp, at a temperature level that is at least as high as said decomposition temperature.

2. A light source device according to claim 1, wherein said optical member is a reflector having a reflective front surface facing said lamp.

3. A light source device according to claim 2, wherein said temperature controlling means comprises means for electrically heating said reflective front surface.

4. A light source device according to claim 3, wherein said means for electrically heating said reflective front surface comprises an electrical heater on a rear surface of said reflector and means for regulating the operation of said electrical heater.

5. A light source device according to claim 2, wherein said temperature controlling means comprises insulating means for reducing heat dissipation from said reflector.

6. A light source device according to claim 5, wherein said insulating means comprises solid insulation mounted on a rear surface of said reflector.

7. A light source device according to claim 5, wherein said insulating means comprises means defining an insulating space behind a rear surface of said reflector.

8. A light source device according to claim 7, wherein said insulating space is evacuated.

9. A light source device according to claim 7, wherein said insulating space is filled with an insulating gas.

10. A light source device according to claim 1, wherein said optical member is a concave reflector surrounding said lamp.

11. A light source device according to claim 1, further comprising a case for housing said lamp and said optical member and for shielding said lamp and said optical member from ambient conditions exterior to said case.

12. A light source device according to claim 1, wherein said optical member has a heat resistive temperature higher than said decomposition temperature, and wherein the temperature set by said temperature controlling means is less than said heat resistive temperature.

13. A light source device according to claim 1, wherein said contaminant is a sulphur compound.

14. A light source device according to claim 1, wherein said contaminant is ammonium sulphate.

15. A light source device for radiating an illumination light onto an object, comprising:

a lamp for emitting an illumination light;

a reflective optical member having a front side disposed near said lamp and including a reflection surface for reflecting said illumination light toward said object, said reflective optical member having a heat resistive temperature which is above a decomposition temperature of a sulfuric acid derived compound;

means for supplying cooling gas to a space between said lamp and said reflective optical member to forcibly cool said lamp; and means provided on a rear side of said reflective optical member electrically heating the reflection surface of said reflective optical member to a temperature which is above said decomposition temperature and less than said heat resistive temperature in order to prevent deposition of said sulfuric acid derived compound on the reflection surface of said reflective optical member, which might otherwise occur due to influence of said illumination light and heat from said lamp and cooling of said reflective optical member by said cooling gas.

16. A light source device according to claim 15, wherein said reflective optical member is a concave mirror surrounding said lamp.

17. A light source device according to claim 15, further comprising a case for housing said lamp and said reflective optical member for shielding said lamp and said reflective optical member from the exterior of the case.

18. An exposure apparatus for exposing a pattern formed on a mask onto a photosensitive member with an illumination light from an illumination system, said illumination system comprising:

a lamp for emitting an illumination light;

a reflective optical member having a front side disposed near said lamp and including a reflection surface for reflecting said illumination light toward an object, said reflective optical member having a heat resistive temperature which is above a decomposition temperature of a sulfuric acid derived compound;

means for supply cooling gas to a space between said lamp and said reflective optical member to forcibly cool said lamp;

means provided on a rear side of said reflective optical member electrically heating the reflection surface of said reflective optical member to a temperature which is above said decomposition temperature and less than said heat resistive temperature in order to prevent deposition of said sulfuric acid derived compound on the reflection surface of said reflective optical member, which might otherwise occur due to influence of said illumination light and heat from said lamp and cooling of said reflective optical member by said cooling gas.

19. An exposure apparatus according to claim 18, wherein said reflective optical member is a concave mirror surrounding said lamp.

20. An exposure apparatus according to claim 18, further comprising a case for housing said lamp and said reflective optical member for shielding said lamp and said reflective optical member from the exterior of the case.

* * * * *